US007753121B2

(12) United States Patent
Whitsitt et al.

(10) Patent No.: US 7,753,121 B2
(45) Date of Patent: Jul. 13, 2010

(54) WELL COMPLETION SYSTEM HAVING PERFORATING CHARGES INTEGRATED WITH A SPIRALLY WRAPPED SCREEN

(75) Inventors: John R. Whitsitt, Houston, TX (US); Vladimir Vaynshteyn, Sugar Land, TX (US); Steven W. Henderson, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 161 days.

(21) Appl. No.: 11/380,755

(22) Filed: Apr. 28, 2006

(65) Prior Publication Data

US 2007/0251690 A1 Nov. 1, 2007

(51) Int. Cl.
*E21B 43/11* (2006.01)
*E21B 43/08* (2006.01)

(52) U.S. Cl. ..... 166/297; 166/378; 166/233; 166/55.1

(58) Field of Classification Search ..... 166/55.1, 166/227, 297, 378, 231, 232, 233
See application file for complete search history.

(56) References Cited

U.S. PATENT DOCUMENTS 3,863,718 A 2/1975 Bruist
4,372,384 A 2/1983 Kinney
4,541,484 A 9/1985 Salerni et al. ..... 166/278
4,541,486 A * 9/1985 Wetzel et al. ..... 166/297
4,547,298 A 10/1985 Novak
4,627,496 A 12/1986 Ashford et al.
5,174,379 A 12/1992 Whiteley et al. ..... 166/278
5,379,838 A 1/1995 Wilson et al.
5,445,228 A 8/1995 Rathmell et al.
5,494,107 A 2/1996 Bode
5,505,260 A * 4/1996 Andersen et al. ..... 166/278
5,507,345 A * 4/1996 Wehunt et al. ..... 166/285
5,829,538 A 11/1998 Wesson et al.
5,881,814 A 3/1999 Mills
5,890,538 A 4/1999 Beirute et al.

(Continued)

FOREIGN PATENT DOCUMENTS

EP 0288237 10/1988

(Continued)

OTHER PUBLICATIONS

Office Action dated Mar. 5, 2008 from U.S. Appl. No. 11/162,216.

(Continued)

*Primary Examiner*—David J Bagnell
*Assistant Examiner*—David Andrews
(74) *Attorney, Agent, or Firm*—David G. Matthews; Rodney V. Warfford; Trop, Pruner & Hu, P.C.

(57) ABSTRACT

An assembly that is usable with a well includes a base pipe, a screen and at least one perforating charge. The base pipe includes at least one radial port to communicate well fluid, and the base pipe has an outer surface. The screen is mounted to the base pipe and is adapted to at least partially surround the base pipe. The radial port(s) of the base pipe are covered by the screen. The perforating charge(s) are mounted to the outer surface of the base pipe.

21 Claims, 11 Drawing Sheets

U.S. PATENT DOCUMENTS

| | | | | |
|---|---|---|---|---|
| 6,206,100 | B1 | 3/2001 | George et al. | 166/278 |
| 6,286,598 | B1 | 9/2001 | van Petegem et al. | 166/297 |
| 6,298,914 | B1 * | 10/2001 | Spray et al. | 166/227 |
| 6,364,017 | B1 | 4/2002 | Stout et al. | 166/278 |
| 6,457,518 | B1 * | 10/2002 | Castano-Mears et al. | 166/207 |
| 6,494,261 | B1 * | 12/2002 | Pahmiyer | 166/281 |
| 6,497,284 | B2 * | 12/2002 | van Petegem et al. | 166/297 |
| 6,536,524 | B1 | 3/2003 | Snider | |
| 6,557,636 | B2 | 5/2003 | Cernocky et al. | |
| 6,568,474 | B2 | 5/2003 | George et al. | 166/297 |
| 6,575,245 | B2 | 6/2003 | Hurst | |
| 6,584,406 | B1 | 6/2003 | Harmon et al. | |
| 6,695,054 | B2 | 2/2004 | Johnson | |
| 6,745,834 | B2 | 6/2004 | Davis et al. | 166/250.17 |
| 6,848,510 | B2 * | 2/2005 | Bixenman et al. | 166/385 |
| 6,885,918 | B2 | 4/2005 | Harmon et al. | |
| 6,962,202 | B2 | 11/2005 | Bell et al. | |
| 6,962,203 | B2 | 11/2005 | Funchess | 166/297 |
| 7,131,494 | B2 | 11/2006 | Bixenmann | |
| 7,152,676 | B2 | 12/2006 | Vella et al. | |
| 7,278,484 | B2 | 10/2007 | Vella et al. | |
| 2001/0027864 | A1 | 10/2001 | Vahnshteyn | |
| 2002/0088620 | A1 | 7/2002 | Lerche et al. | |
| 2002/0092649 | A1 * | 7/2002 | Bixenman et al. | 166/278 |
| 2002/0125011 | A1 | 9/2002 | Snider et al. | |
| 2003/0000411 | A1 | 1/2003 | Cernocky et al. | |
| 2003/0001753 | A1 | 1/2003 | Cernocky et al. | |
| 2003/0098157 | A1 | 5/2003 | Hales et al. | |
| 2003/0230406 | A1 | 12/2003 | Lund | |
| 2004/0016539 | A1 * | 1/2004 | Richard | 166/207 |
| 2004/0107825 | A1 | 6/2004 | Kash | |
| 2004/0129419 | A1 | 7/2004 | Van Wulfften Palthe | |
| 2004/0159432 | A1 | 8/2004 | Johnson et al. | |
| 2004/0188093 | A1 * | 9/2004 | Funchess | 166/299 |
| 2004/0251024 | A1 | 12/2004 | Jones | |
| 2004/0251033 | A1 | 12/2004 | Cameron et al. | |
| 2004/0262011 | A1 * | 12/2004 | Huckabee et al. | 166/369 |
| 2005/0045329 | A1 * | 3/2005 | Wetzel et al. | 166/278 |
| 2005/0109508 | A1 | 5/2005 | Vella et al. | |
| 2005/0178554 | A1 | 8/2005 | Hromas et al. | |
| 2007/0044964 | A1 | 3/2007 | Grigar | |

FOREIGN PATENT DOCUMENTS

| | | | |
|---|---|---|---|
| EP | 0628699 | | 12/1993 |
| GB | 2296924 | B | 4/1997 |
| GB | 2296925 | B | 4/1997 |
| GB | 2297107 | | 4/1997 |
| GB | 2352261 | | 1/2001 |
| GB | 2397594 | | 7/2004 |
| GB | 2395962 | | 9/2004 |
| WO | WO 95/09965 | A1 | 4/1995 |
| WO | WO 95/09966 | A1 | 4/1995 |
| WO | WO 95/09967 | A1 | 4/1995 |
| WO | WO 95/09968 | A1 | 4/1995 |
| WO | WO 95/017577 | A1 | 6/1995 |
| WO | WO 00/65195 | | 11/2000 |
| WO | WO 03/002849 | | 1/2003 |

OTHER PUBLICATIONS

Combined Search and Examination Report from Great Britain Application No. GB 0610496.2.

* cited by examiner

WELL COMPLETION SYSTEM HAVING PERFORATING CHARGES INTEGRATED WITH A SPIRALLY WRAPPED SCREEN

BACKGROUND

The invention generally relates to a well completion system and more particularly relates to a sandface completion.

Several downhole trips, or runs, typically are required to complete a well. For example, several trips typically are required to perforate and gravel pack the well.

As an example, the following procedure may be used to perforate and gravel pack a well. First, a string with a plug running tool is run downhole to install a plug in a previously-installed sump packer. The string is withdrawn from the well, and in a subsequent trip, a string that contains one or more perforating guns is lowered into the well. The perforating charges of the gun(s) are then fired; and subsequently, this string is pulled out of the well. Next, a cleanup string that contains, for example, a circulation valve, scraper and washing tool may be run downhole for purposes of cleaning the well. The cleanup string is pulled out of the well, and subsequently, another string is run downhole to remove the plug from the sump packer. After the string that removes the plug is retrieved from the well, a string that contains a bottom hole assembly is run into the well. The bottom hole assembly typically includes a sandscreen to support a filtering gravel substrate that is deposited around the sandscreen in a subsequent gravel packing operation. The running string (the portion of the string above the bottom hole assembly) is retrieved from the well upon completion of the gravel packing operation.

In general, the fluid loss in the well increases with the number of downhole trips. Fluid losses invade the formation, and may have such detrimental effects as increasing the skin, causing near wellbore damage and impairing the overall productivity of the well.

Thus, there is a continuing need for better ways to reduce the number of trips into a well for purposes of performing completion operations, such as perforating and gravel packing operations.

SUMMARY

In an embodiment of the invention, an assembly that is usable with a well includes a base pipe, a screen and at least one perforating charge. The base pipe includes at least one radial port to communicate well fluid, and the base pipe has an outer surface. The screen is mounted to the base pipe and is adapted to at least partially surround the base pipe. The radial port(s) of the base pipe are covered by the screen. The perforating charge(s) are mounted to the outer surface of the base pipe.

In another embodiment of the invention, a technique that is usable with a well includes running an assembly into the well in a single trip. The assembly includes a screen, a base pipe and a perforating gun. The perforating gun has perforating charges that are located on the outside of the base pipe. The technique includes firing the perforating charges.

Advantages and other features of the invention will become apparent from the following drawing, description and claims.

DETAILED DESCRIPTION

Figure 1:
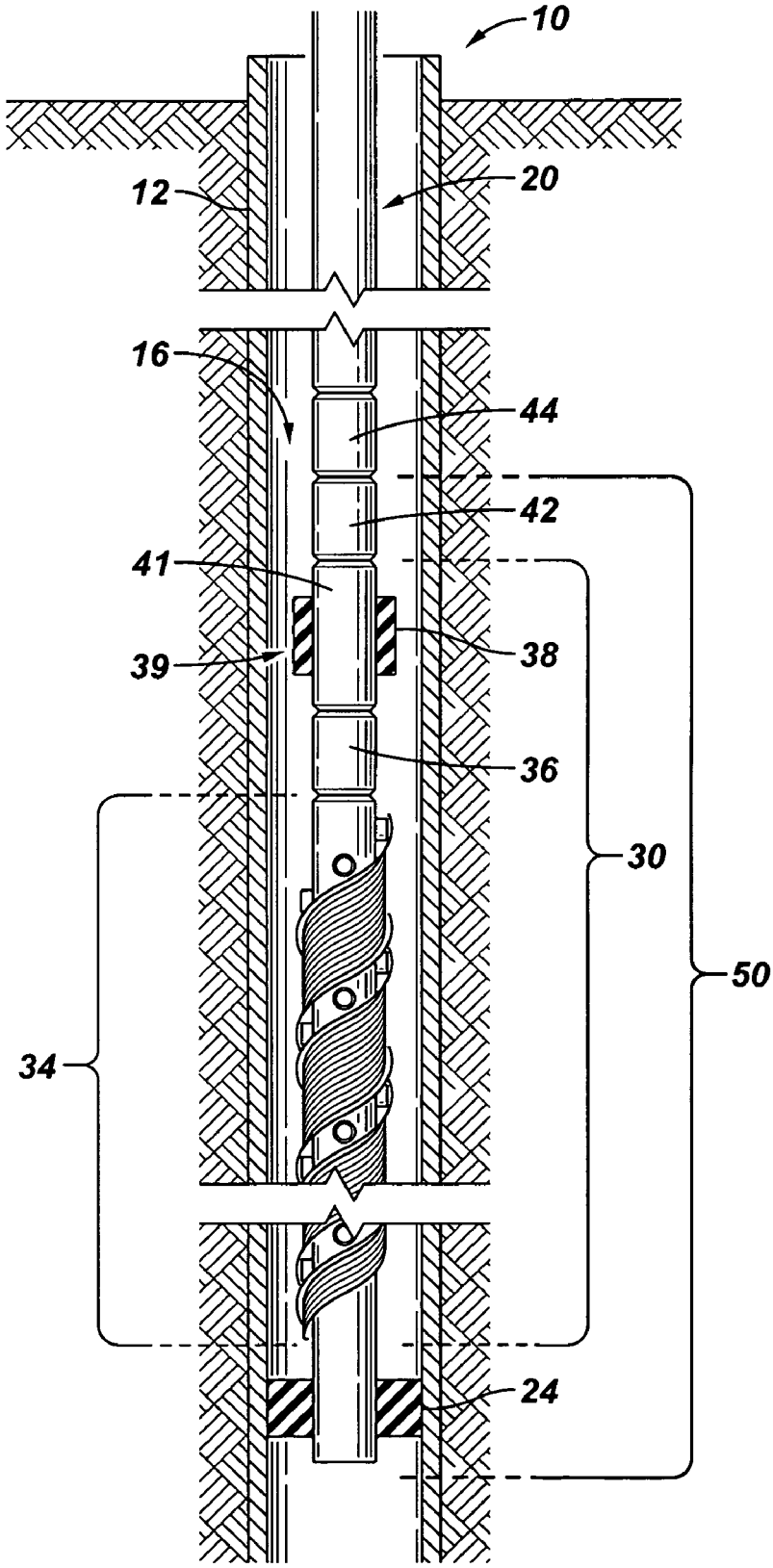
FIG. 1 is a schematic diagram of a well according to an embodiment of the invention.

Referring to FIG. 1, an exemplary embodiment of a well 10 in accordance with the invention includes a tubular string 20 that extends from the surface into a wellbore 16 of the well 10. As depicted in FIG. 1, the wellbore 16 may be lined with a casing string 12. Although FIG. 1 depicts the wellbore 16 as being vertical, in other embodiments of the invention, the system and techniques that are described herein may likewise be applied to lateral wellbores. Additionally, the system and techniques that are described herein may be applied to both subterranean and subsea wells.

The string 20 includes a bottom hole assembly (BHA) 30 that, as further described below, may be used for such purposes as isolating a particular zone, or interval, of the well 10; perforating the interval; installing a sandscreen in the interval; and communicating flows for purposes of cleaning and gravel packing the interval. Thus, the components of the string 20 (such as the BHA 30 and other components of the string 20, described below) may form a single trip sandface completion system, in accordance with some embodiments of the invention. Advantages of consolidating downhole trips include (as examples) reduced rig time, reduced fluid loss and avoidance of detrimental effects that are attributable to fluid loss.

Turning now to the more specific details, in accordance with some embodiments of the invention, the BHA 30 includes a combined sandscreen and perforating assembly 34 that contains a sandscreen in addition to perforating charges that are exposed between windings of the sandscreen. As further described below, the perforating charges are positioned so that after the firing of the perforating charges, the sandscreen retains its integrity, and all flow across the sandscreen is filtered.

The BHA 30 also includes, in accordance with some embodiments of the invention, a firing head 36 for purposes of firing the perforating charges of the assembly 34; and a combined packer and sandscreen extension assembly 39. The firing head 36 may be activated in a variety of different ways for purposes of firing the perforating charges of the assembly 34. For example, in accordance with some embodiments of the invention, the firing head 36 is electrically coupled to a sensor 44 (a pressure sensor, for example) of the string 20, which is located downhole with the firing head 36. The sensor 44 may, for example, be used by the firing head 36 to detect stimuli that are communicated downhole (from the surface of the well, for example) for purposes of instructing the firing head 36 to fire the perforating charges.

The stimuli may be, as examples, a particular tubing pressure or pressure signature inside the string 20; a particular tubing pressure or pressure signature in an annulus that surrounds the string 20; or a particular stimuli that is communicated downhole on the string 20.

In other embodiments of the invention, the firing head 36 may be configured to receive commands via the load, or weight, forces on the string 20. Thus, the string 20 may be lifted up and down in accordance with a predetermined pattern for purposes of firing the perforating charges.

As examples of other communication techniques, a wired connection (such as through a wireline or cable) or a slickline may be used for purposes of communicating with and controlling the firing head 36. Therefore, many different techniques may be used to communicate with and control the firing head 36, all of which are within the scope of the appended claims.

Figure 5:
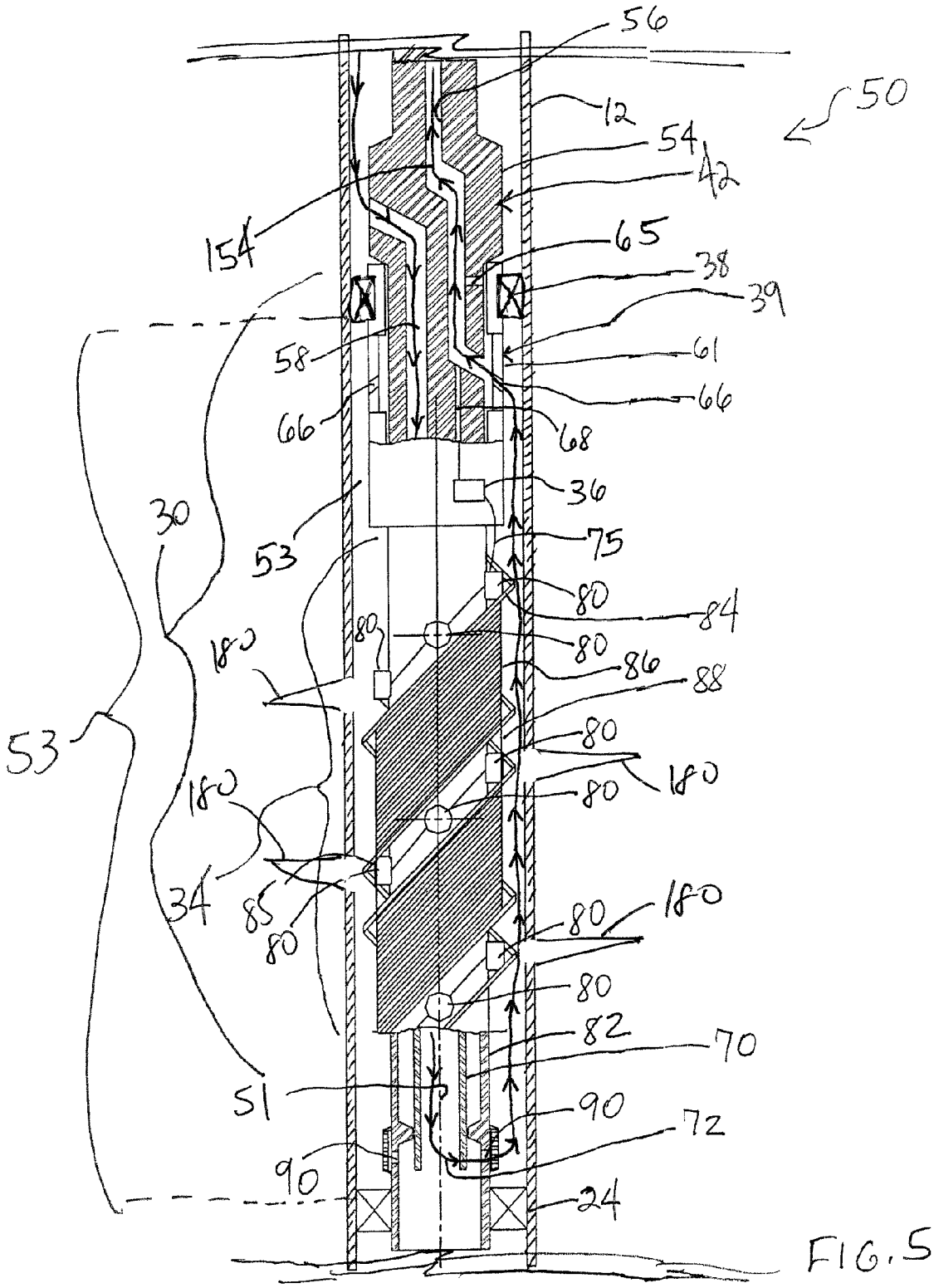
FIG. 5 is a schematic diagram of the string segment illustrating a configuration of a service tool for purposes of cleaning out an isolated interval of the well according to an embodiment of the invention.

The packer and sandscreen extension assembly 39 includes a packer 38 (depicted in its unset state in FIG. 1) that is set when the BHA 30 is in the proper downhole position for purposes establishing an upper boundary of an isolated interval 53 (see FIG. 5). The lower boundary of the isolated interval 53 is established by a previously-installed sump packer 24.

Still referring to FIG. 1, more specifically, in accordance with some embodiments of the invention, the BHA 30 is operated in the following manner to form an isolated interval (such as the isolated interval 53 that is depicted in FIG. 5) in the well 10. First, the string 20 is lowered downhole and is stabbed into the sump packer 24. At this point, the sump packer 24 forms an annular seal between the inner surface of the casing string 12 and the outer surface of the string 20. The packer 38 is then set (via, for example, a technique similar to the techniques described above for controlling the firing head 36) to form another annular seal between the string 20 and the interior surface of the casing string 12 to form the upper boundary of the isolated interval. After this point, perforating and gravel packing operations may then be performed in the isolated interval, as further described below.

In addition to the packer 38, the packer and sandscreen extension assembly 39 also includes an extension sleeve 41 that extends to connect the packer 38 to the portion of the BHA 30 below the packer 38. As described below, after the desired gravel packing and cleaning operations are performed, the portion of the string 20 above the assembly 39 may be disconnected and retrieved from the well, thereby leaving the BHA 30 downhole as part of the completion.

Among the other features of the string 20, in accordance with some embodiments of the invention, the string 20 may include a multiple function service tool 42. The service tool 42 provides a releasable connection for the BHA 30 with the string 20 and provides multiple fluid paths. The fluid flow through these fluid paths may be controlled (via one of the control techniques that are listed above for the firing head 36, for example) to perform various operations, such as flowing a slurry from the central passageway of the string 20 into the annulus of the isolated interval to perform slurry gravel packing, or communicating fluid from the isolated interval into the central passageway of the string 20 for purposes of cleaning out the interval.

Figure 2:
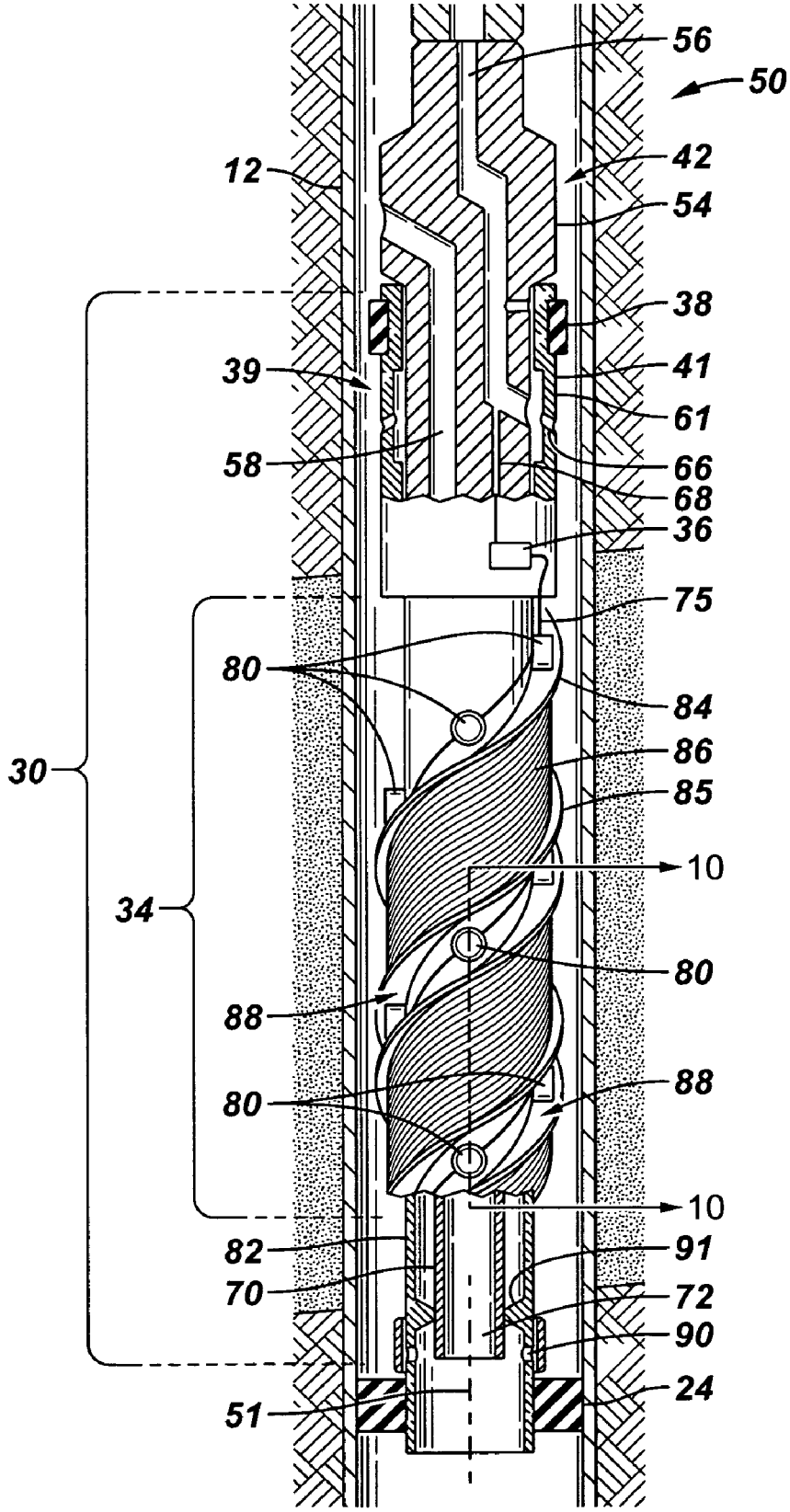
FIG. 2 is a more detailed schematic diagram of a segment of a string of FIG. 1 illustrating a bottom hole assembly according to an embodiment of the invention.

FIG. 2 depicts a more detailed segment 50 (see FIG. 1) of the string 20 near the BHA 30, in accordance with some embodiments of the invention. Referring to FIG. 2, in accordance with some embodiments of the invention, the combined sandscreen and perforating assembly 34 includes a perforated base pipe 82 that contains radial openings (not depicted in FIG. 2), or ports, for purposes of receiving well fluid into the central passageway of the pipe 82 when the BHA 30 is left downhole as part of the completion. The sandscreen and perforating assembly 34 also includes perforating charges 80 (lined shaped charges, as an example), which are mounted to the exterior surface of the base pipe 82. Therefore, in accordance with some embodiments of the invention, the perforating charges 80 do not breach the base pipe 82 either before or after the perforating charges 80 are fired.

As depicted in FIG. 2, in accordance with some embodiments of the invention, the perforating charges 80 may extend in a spiral or helical, phasing pattern around the exterior of the base pipe 82. The perforating charges 80 may be connected to a detonating cord 75 that extends around the exterior of the base pipe 82 and is connected to the firing head 36 to communicate a detonation wave to the shaped charges 80 when the charges 80 are to be fired.

The sandscreen and perforating assembly 34 also includes a screen 86 (a sandscreen, for example) that is mounted to and extends around the base pipe 82. In accordance with some embodiments of the invention, the screen 86 extends around the base pipe 82 in the same helical, or spiral, pattern as the perforating charges 80. The screen 86 is wrapped around the base pipe 82 in a fashion such that channels 88 are formed between adjacent windings (i.e., no other winding of the screen 86 is between the adjacent windings) of the screen 86 to expose the perforating charges 80. The radial well fluid ports (not shown in FIG. 2) of the base pipe 82 are arranged to coincide with the above-described wrapping so that all of the ports are covered by the screen 86.

Due to the above-described arrangement of the sandscreen and the perforating charges 80, the screen 86 retains its integrity after the firing of the perforating charges 80; and all flow into the base pipe 82 during production is filtered by the screen 86. It is noted that the screen 86 may be a direct wire wrapped screen, in accordance with some embodiments of the invention, although other types of screens may be used in other embodiments of the invention.

As depicted in FIG. 2, in accordance with some embodiments of the invention, the sandscreen 86 may radially vary to protect the perforating charges 80. For example, in some embodiments of the invention, screen 86 may include upper 84 and lower 85 radial extensions at its upper and lower edges, respectively. The radial extensions 84 and 85 line the channels 88 and radially extend beyond the perforating charges 80 for purposes of protecting the charges 80 and the remaining portion of the screen 86. The radial extensions 84 and 85 may not be part of the screen 86 in other embodiments of the invention, as described below in connection with FIG. 8.

Still referring to FIG. 2, among the other features of the sandscreen and perforating assembly 34, the base pipe 82 may be concentric with a longitudinal axis 51 of the BHA 30 and may have a lower end that is configured to form a seal with the sump packer 24 when the BHA 30 is stabbed into the packer 24. Near the sump packer 24, the base pipe 82 may also include radial ports 90 for purposes of communicating a flow with the isolated interval 53 (see FIG. 5, for example). The ports 90 are located below an inner annular extension 91 of the base pipe 82, which forms a seal with a tubing 70 that extends inside the base pipe 82 from the service tool 42. Thus, a flow may be communicated from the central passageway of the tubing 70 to the isolated interval 53 and vice versa. The tubing 70 has a lower end 72 that is exposed near the ports 90.

In accordance with some embodiments of the invention, the service tool 42 has a body 54 that includes a passageway 56 for purposes of communicating fluid from the central passageway of the string 20 (see FIG. 1) to the isolated interval 53 (see FIG. 5) and a passageway 58 for purposes of communicating fluid from the central passageway of the tubing 70 to an annular region above the isolated interval 53 (i.e., above the packer 38 when set). The service tool 42 may include other passageways, such as, for example, a passageway 68, which establishes fluid communication between the passageway 56 and the packer 38 for purposes of setting the packer 38. A passageway 68 of the service tool 42 establishes fluid communication between the passageway 56 and the firing head 36 for purposes of communicating pressure to the firing head 36 (to cause the firing head 36 to fire, for example).

As depicted in FIG. 2, the bottom end of the service tool 42 is received into the extension sleeve 41 of the packer and sandscreen extension assembly 39 and is aligned such that radial ports 66 of the sleeve 61 are aligned to communicate fluid between the passageway 56 and the isolated interval below the packer 38. The sleeve 61 is generally concentric with the longitudinal axis 51 of the BHA 30.

Figure 3:
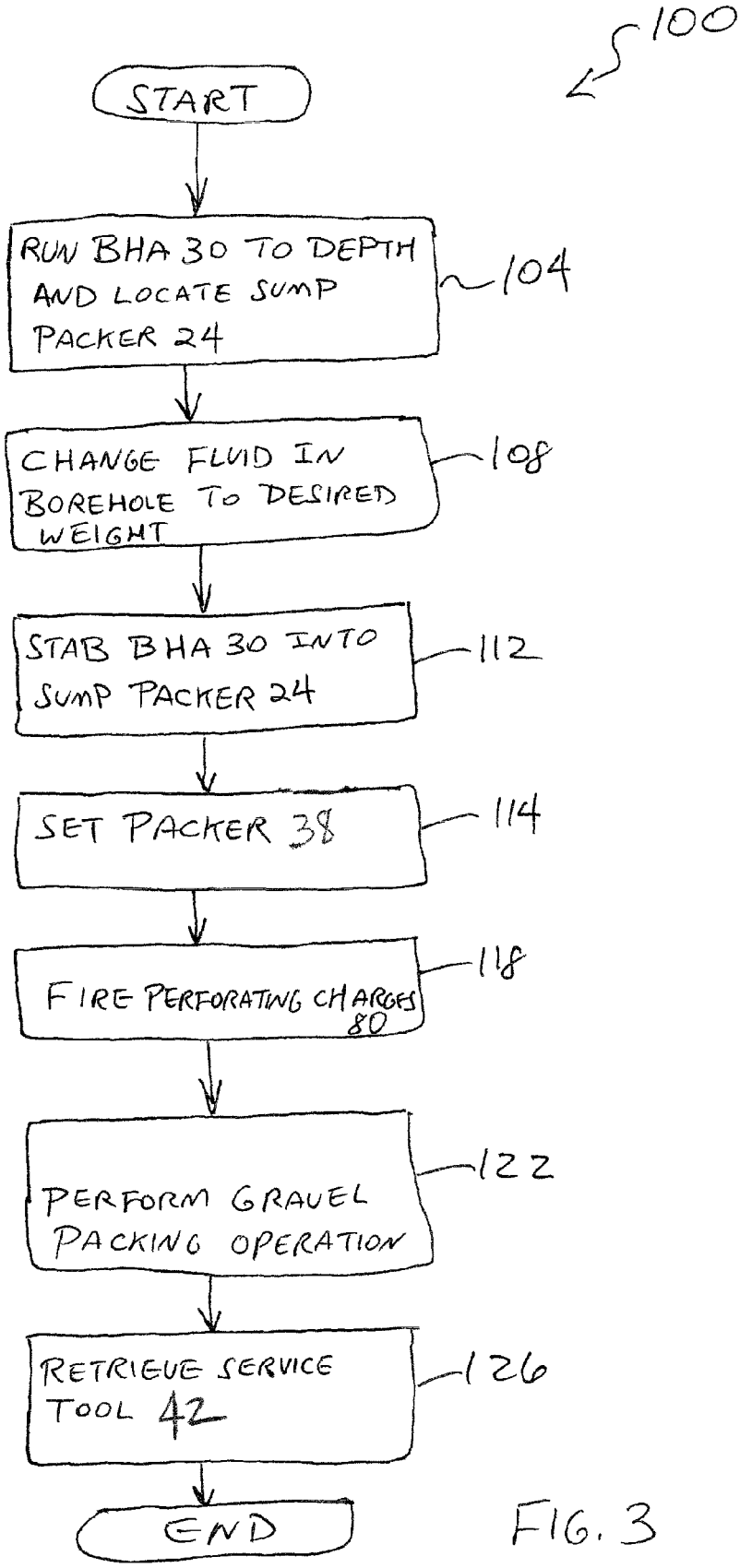
FIG. 3 is a flow diagram depicting a perforating and gravel packing technique according to an embodiment of the invention.

Referring to FIG. 3, in general, a perforating and gravel packing technique 100 operation may be performed in the well 10 using the string 20 in accordance with some embodiments of the invention. Referring to FIG. 3 in conjunction with FIGS. 1 and 2, the technique 100 includes running the BHA 30 to the appropriate depth and locating the sump packer 24, pursuant to block 104.

After the sump packer 24 is located, the fluid in the borehole may be changed to a desired weight, pursuant to block 108. More specifically, the targeted fluid weight may depend on the desired balance at the time of perforating. For example, in certain situations the well may be underbalanced to create a flow from the resulting perforation tunnels into the wellbore for purposes of assisting in cleaning debris from the perforation tunnels. The fluid in the well at the time of perforating may be placed prior to or at the time of the firing of the perforating charges 80, depending on the particular embodiment of the invention.

Figure 4:
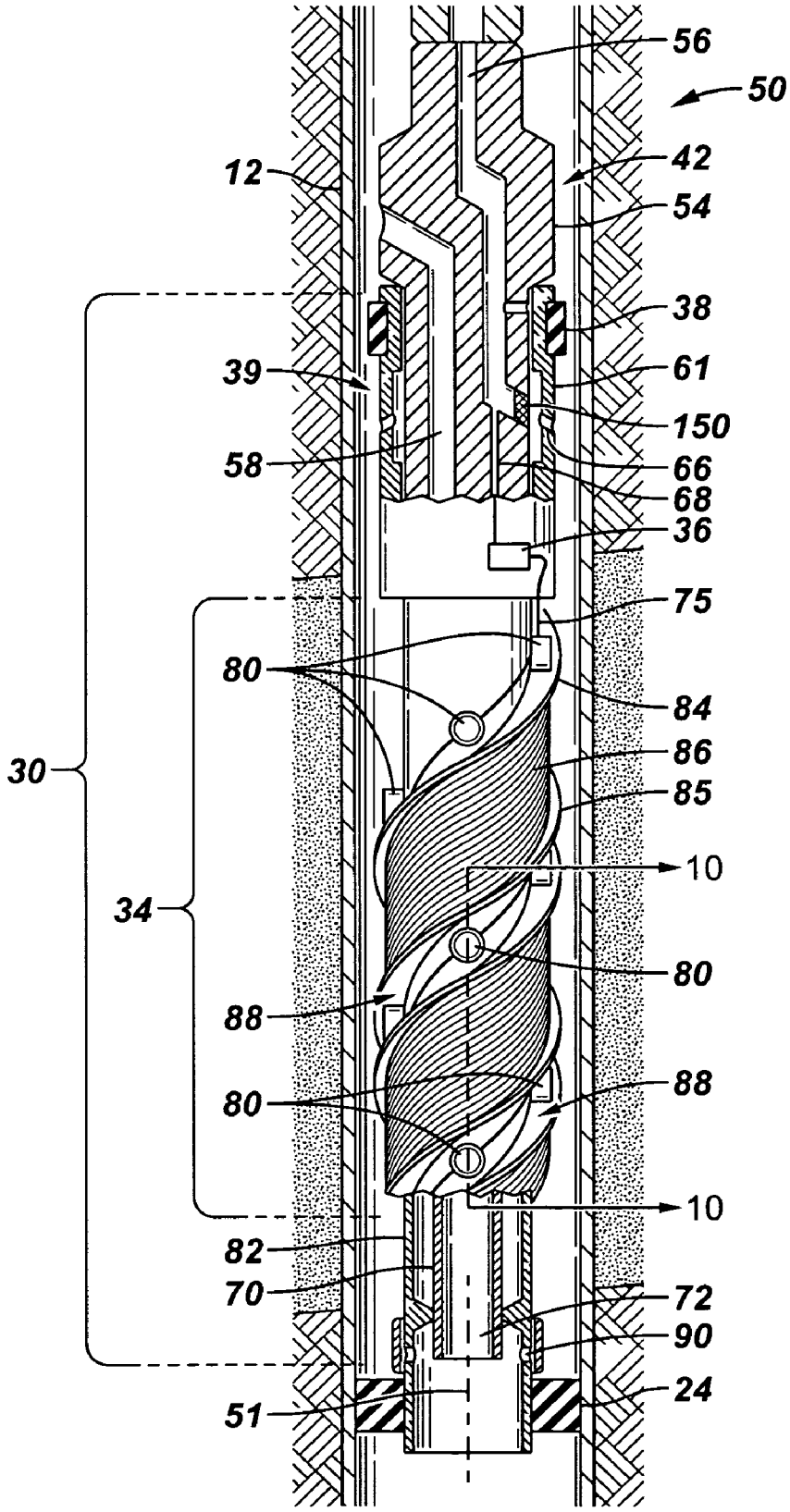
FIG. 4 is a schematic diagram of the string segment illustrating the use of a plug to set a packer of the bottom hole assembly according to an embodiment of the invention.

Still referring to FIG. 3, when the fluid condition is correct, the BHA 30 is stabbed (block 112) into the sump packer 24 to establish a sealing engagement with the packer 24. The pressure in the central passageway of the string 20 may then be increased (as one example) to set the packer 38, pursuant to block 114. For purposes of setting the packer 38, a plug 150 (see FIG. 4) may be run downhole through the central passageway of the tubing 20 and run through the passageway 56 to lodge in a restricted portion of the passageway 56. The set packer 38 is depicted in FIG. 5, which also shows the resultant isolated interval 53. After setting the packer 38, the weight on the string 20 may be varied (by lifting up on the string 20, for example) to verify that the packer 38 holds differential pressure.

Next, pursuant to the technique 100, the perforating charges 80 are fired (block 118). The technique used to fire the perforating charges 80 may include communicating stimuli (wireless, wired-conveyed, tubing-conveyed, fluid-conveyed, string-conveyed, etc.) downhole through fluid, on the string 20, on a cable, etc., depending on the particular embodiment of the invention. The firing of the perforating charges 80 pierces the casing string 12 and forms perforation tunnels 180 (see, for example, FIG. 5) in the surrounding formation.

After the firing of the perforating charges 80, the service tool 42 may then be configured to route fluid flows through a path to clean out the isolated interval 53. For example, referring also to FIG. 5 in conjunction with FIG. 3, in accordance with some embodiments of the invention, the service tool 42 may be configured to circulate fluid from the isolated interval 53 to form a flow 154. Thus, a flow 154 may be circulated into the annulus of the well above the packer 38 (now set) and through the fluid passageway 58, so that the fluid exits the tubing 70 at its end 72. The flow 154 is routed through the radial ports 90 of the tubing 70 and into the isolated interval 53. In the isolated interval 53, debris enters the flow 154. The flow 154 carries the debris back to the service tool 42 and into its fluid passageway 56, where the fluid returns to the surface of the well.

In accordance with some embodiments of the invention, the well is perforated underbalanced. For these embodiments of the invention, the cleaning operation (as illustrated in FIG. 5) is not performed.

Figure 6:
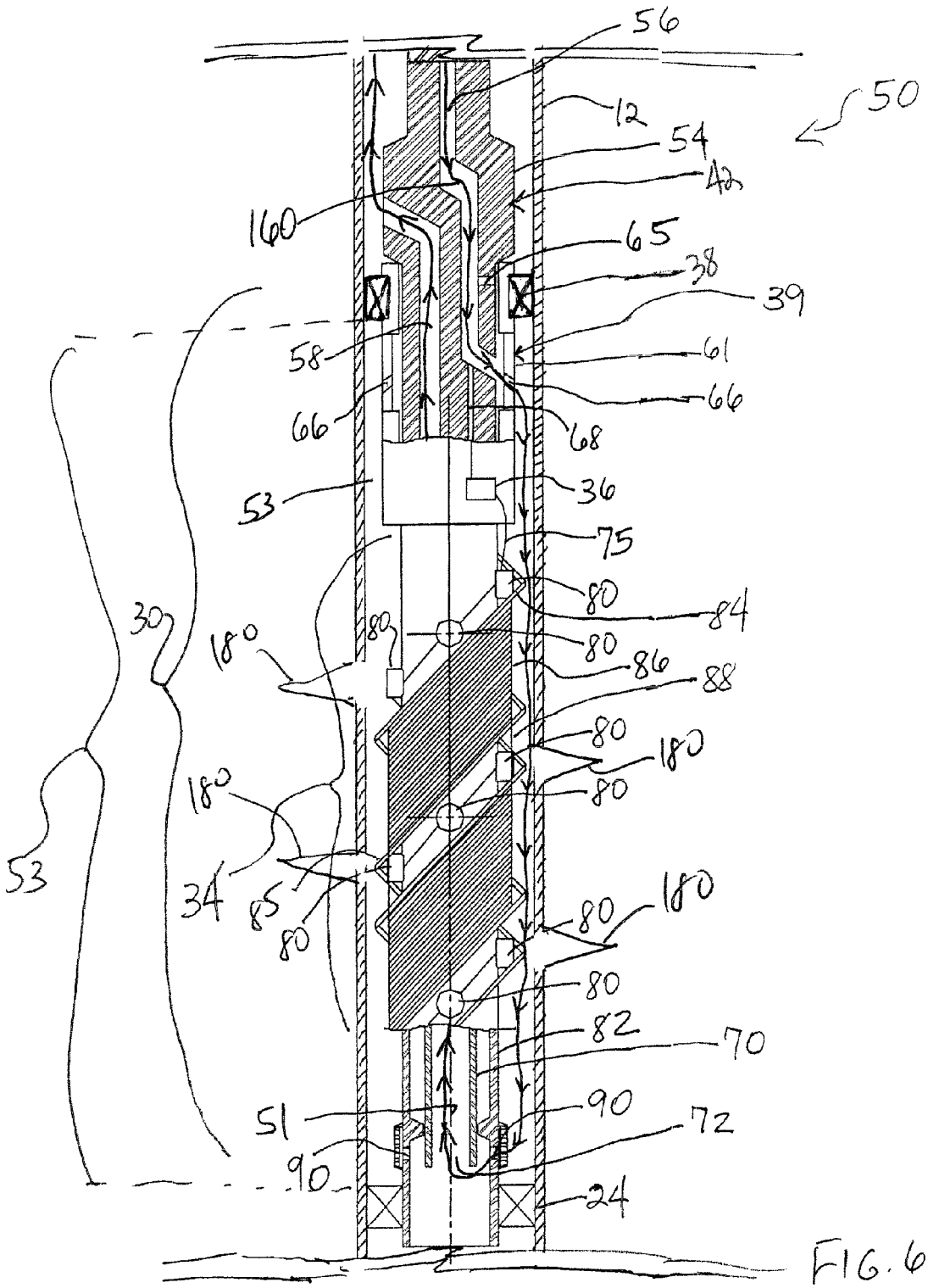
FIG. 6 is a schematic diagram illustrating a configuration of the service tool for purposes of gravel packing an isolated interval of the well according to an embodiment of the invention.

Still referring to FIG. 3, after the cleaning operation, a gravel packing operation may be performed in the isolated interval 53, pursuant to block 122. Referring to FIG. 6 in conjunction with FIG. 3, preparation for the gravel packing operation includes configuring the service tool 42 so that the tool 42 routes a gravel packing slurry flow 160 into the isolated interval 53. More specifically, the slurry flow 160 flows through the central passageway of the string 20 and into the passageway 56 of the service tool 42. From the fluid passageway 56, the slurry flow 160 exits the radial ports 66 of the sleeve 61 and enters the isolated interval 53, where the gravel substrate is deposited. Liquid from the slurry flow flows through the radial ports 90 of the base pipe 82 and into the lower end 72 of the tubing 70. The liquid returns into the annulus above the packer 64 via the passageway 58 of the service tool 42.

After the gravel packing operation, the service tool 42 (and the portion of the string 20 above the service tool 42) is retrieved from the well 10, pursuant to block 126 of FIG. 3.

Figure 7:
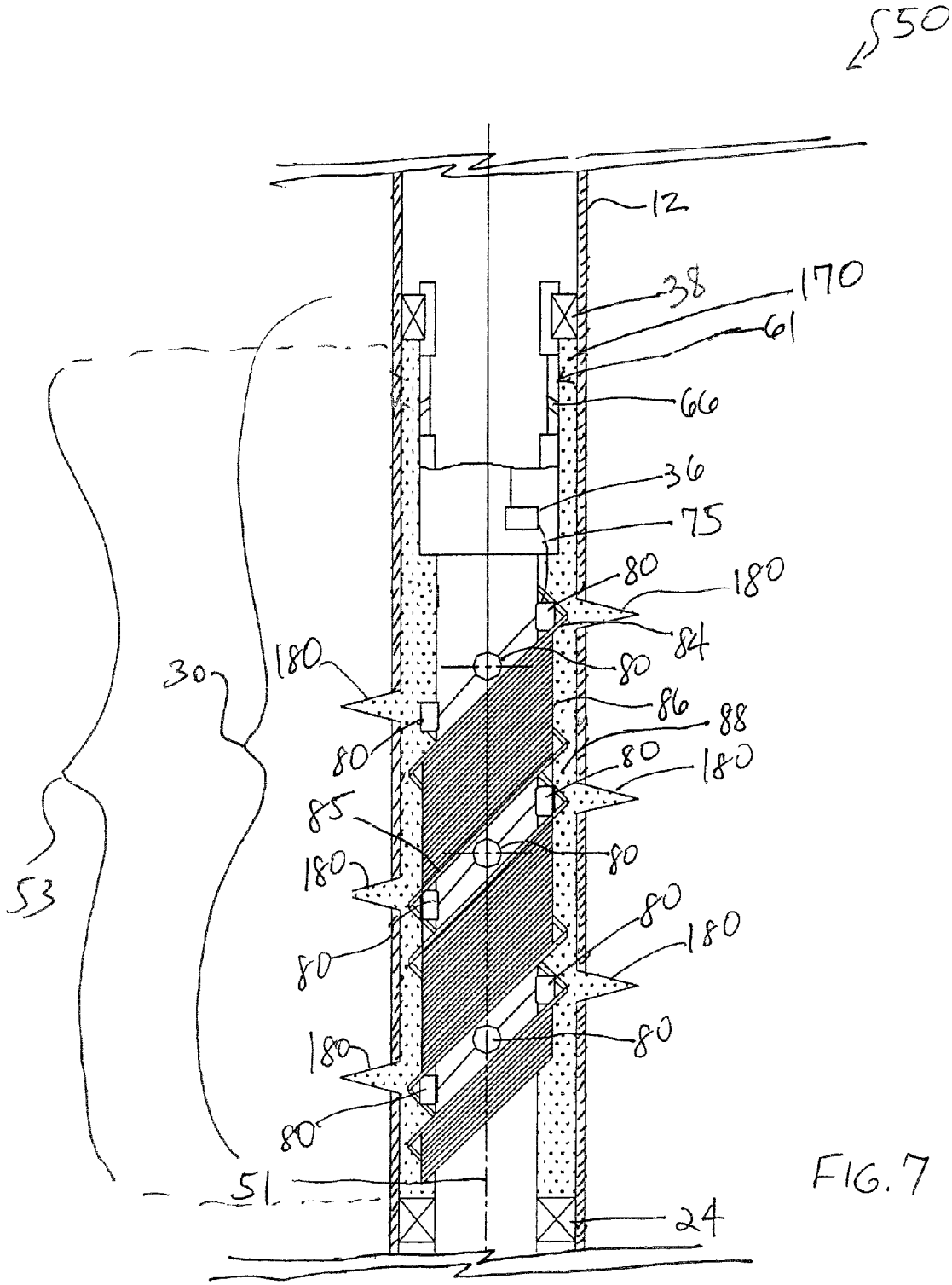
FIG. 7 is a schematic diagram of the bottom hole assembly after a gravel packing operation according to an embodiment of the invention.

FIG. 7 depicts the BHA 30 after retrieval of the service tool 42. As shown, at this point, a gravel substrate 170 resides in the isolated interval 53 and may extend into the perforation tunnels 180. It is noted that a production string may subsequently be run downhole and received into the sleeve 61. Thus, the sleeve 61 may include a stabbing receptacle for purposes of receiving a corresponding and mating stabbing connection of the production string.

Figure 8:
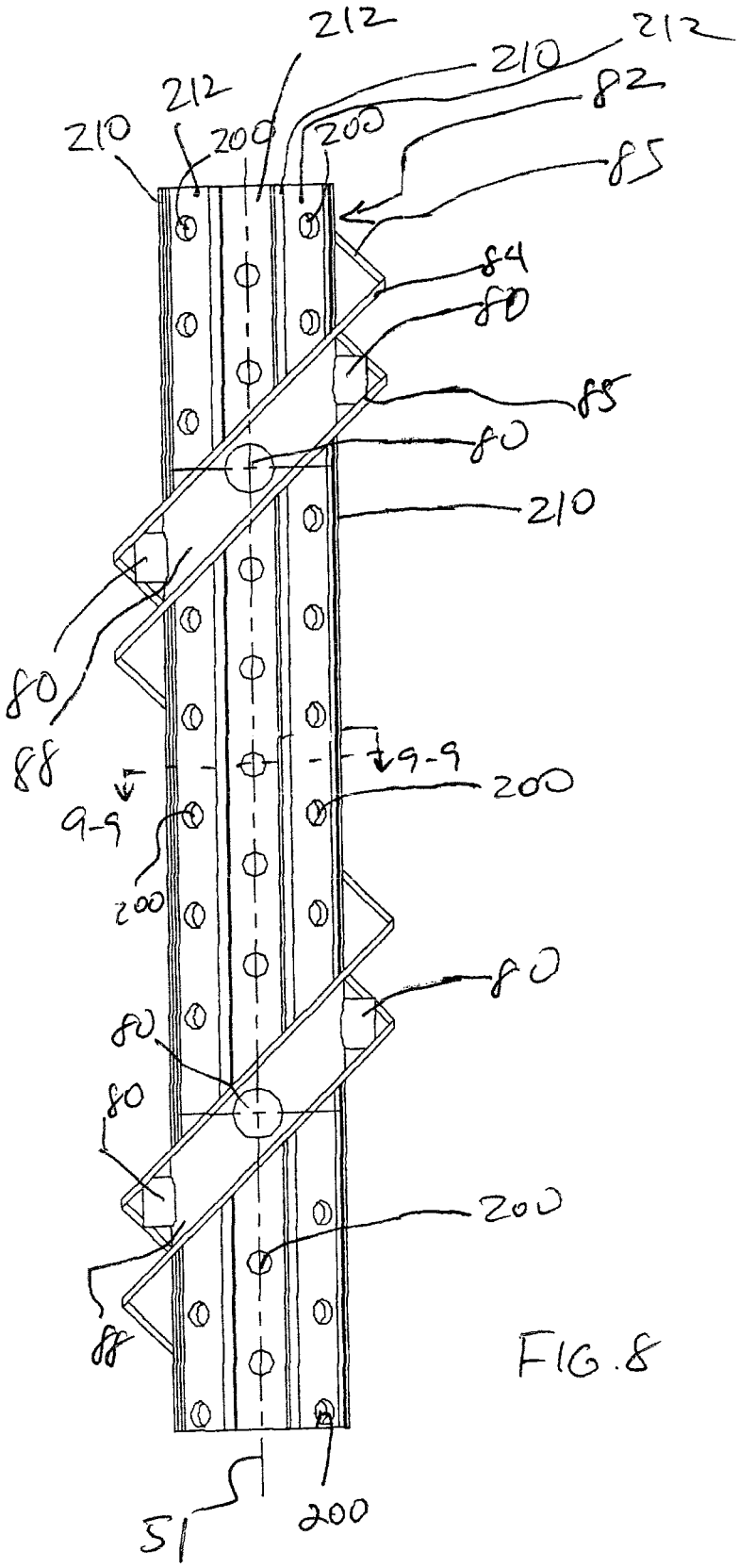
FIG. 8 is a perspective view of a base pipe of the bottom hole assembly according to an embodiment of the invention.

Referring to FIG. 8, in accordance with some embodiments of the invention, the base pipe 82 includes radial openings, or ports 200, to receive well fluid. The radial ports 200 coincide with the portions of the base pipe 82 around which the sandscreen 86 (not depicted in FIG. 8) is wrapped. As also shown in FIG. 8, in accordance with some embodiments of the invention, the radial extensions 84 and 85 may be attached to the exterior of the base pipe 82 and thus, may be separate from the sandscreen 86.

Figure 9:
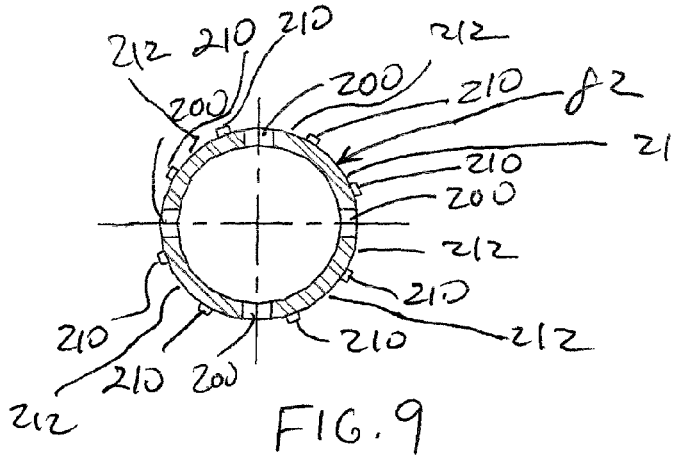
FIG. 9 is a cross-sectional view taken along line 9-9 of FIG. 8 according to an embodiment of the invention.

Additionally, as depicted in FIG. 8, the base pipe 82 may include longitudinal ribs 210 (which are parallel to the longitudinal axis 51) that extend radially outwardly to form ridges, or channels 212, in between for purposes of creating annular spaces inside the sandscreen 86. Referring also to FIG. 9 (depicting a cross-sectional view of the base pipe 82), the openings 200 are disposed in the channels 210; and the longitudinal ribs 210 may be uniformly distributed around the longitudinal axis 51.

Figure 10:
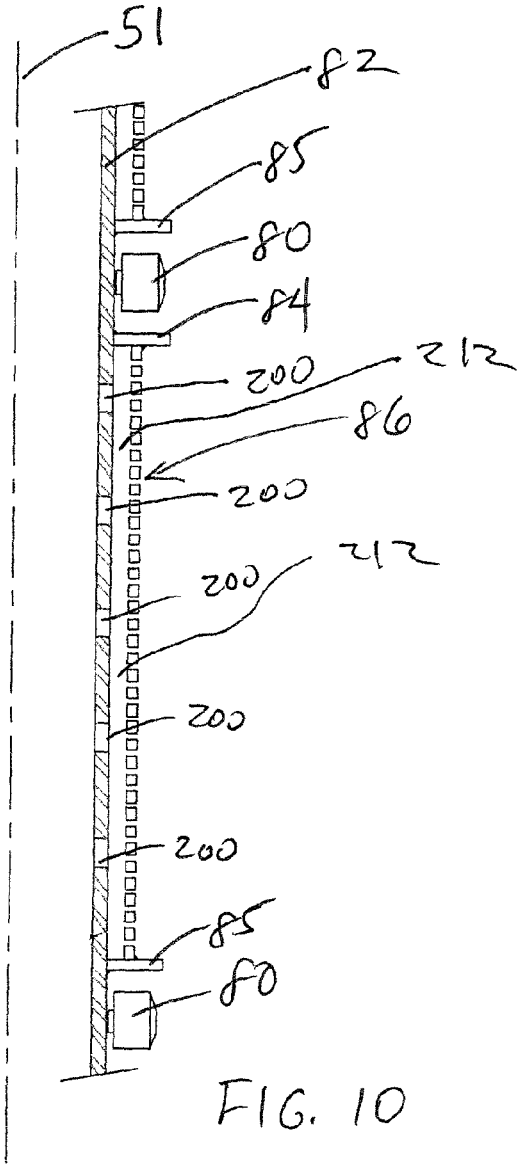
FIG. 10 is a partial cross-sectional view taken along line 10-10 of FIG. 2 according to an embodiment of the invention.

FIG. 10 depicts a partial cross-sectional view taken along line 10-10 of FIG. 2. It is noted that FIG. 10 depicts only the right hand section of the cross-sectional view, as it is understood that a corresponding left hand side exists on the left-hand side of the longitudinal axis 51 in FIG. 10. FIG. 10 illustrates a particular channel 212 that is created between the openings 200 and the sandscreen 86.

Figure 11:
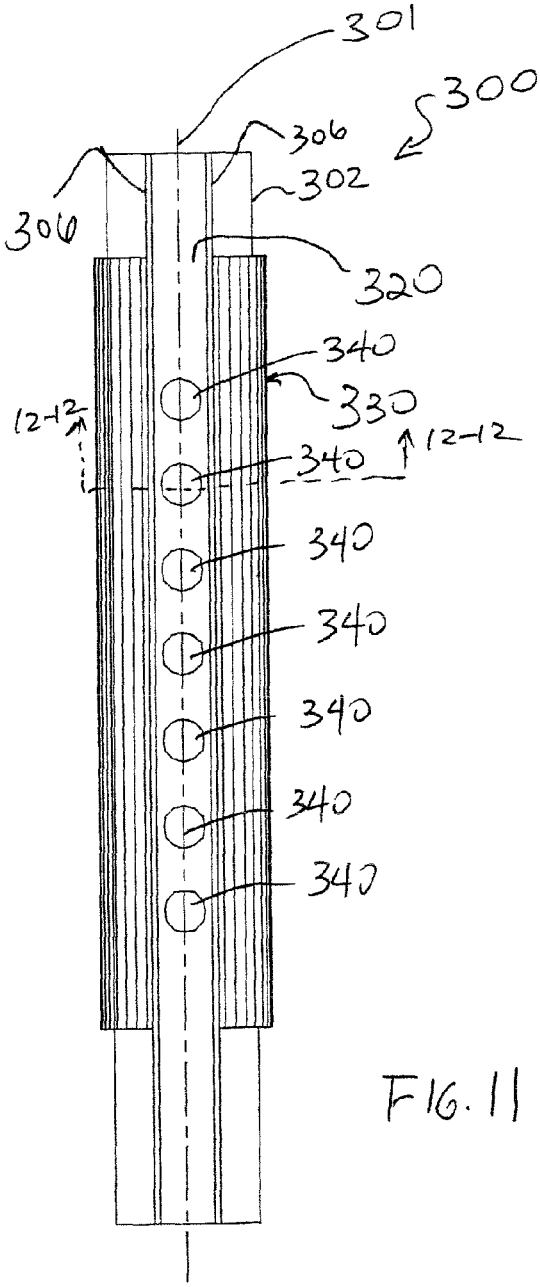
FIGS. 11 and 13 are perspective views of combined perforating and sandscreen assemblies according to other embodiments of the invention.

Many other variations are possible and are within the scope of the appended claims. For example, FIG. 11 depicts a combined perforating and sandscreen assembly 300 that may be used in place of the assembly 34 (see FIG. 2, for example), in accordance with some embodiments of the invention. Unlike the assembly 34, the assembly 300 includes perforating charges 340 that are aligned along a longitudinal axis 301 of the assembly 300. Thus, the assembly 300 may be used for purposes of targeting a particular azimuthal direction in the well.

Figure 12:
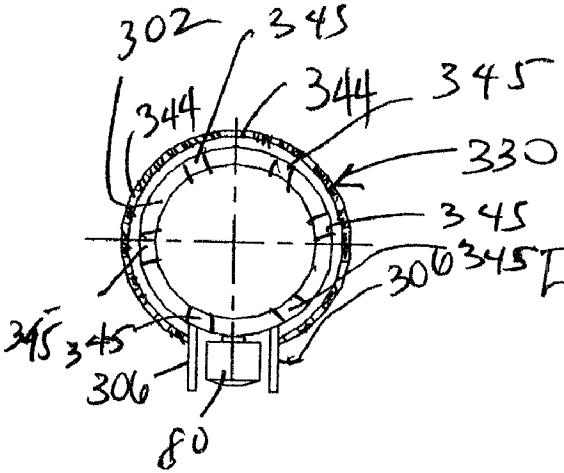
FIG. 12 is a cross-sectional view taken along line 12-12 of FIG. 11 according to an embodiment of the invention.

The assembly 300 includes a sandscreen 330 that partially circumscribes the longitudinal axis 301 to create a longitudinal channel 320 in which the perforating charges 340 are exposed. Similar to the assembly 34, the assembly 300 includes radial extensions 306 that define the boundaries of the channel 320 for purposes of protecting the sandscreen 330 and perforating charges 340; and similar to the assembly 34, the perforating charges 340 may be each located entirely on the outside of the base pipe 302 and not pierce the base pipe 302, either before or after the perforating charges 340 are fired. The radial extensions 306 may be part of the base pipe 302 or may be part of the sandscreen 330, depending on the particular embodiment of the invention. Referring also to FIG. 12, which depicts a cross-section taken along line 12-12 of FIG. 11, the sandscreen 330 may include various longitudinal slots, or openings 344, for purposes of communicating flow of fluid through the sandscreen 330 into corresponding radial openings, or ports 345, of the base pipe 302.

Figure 13:
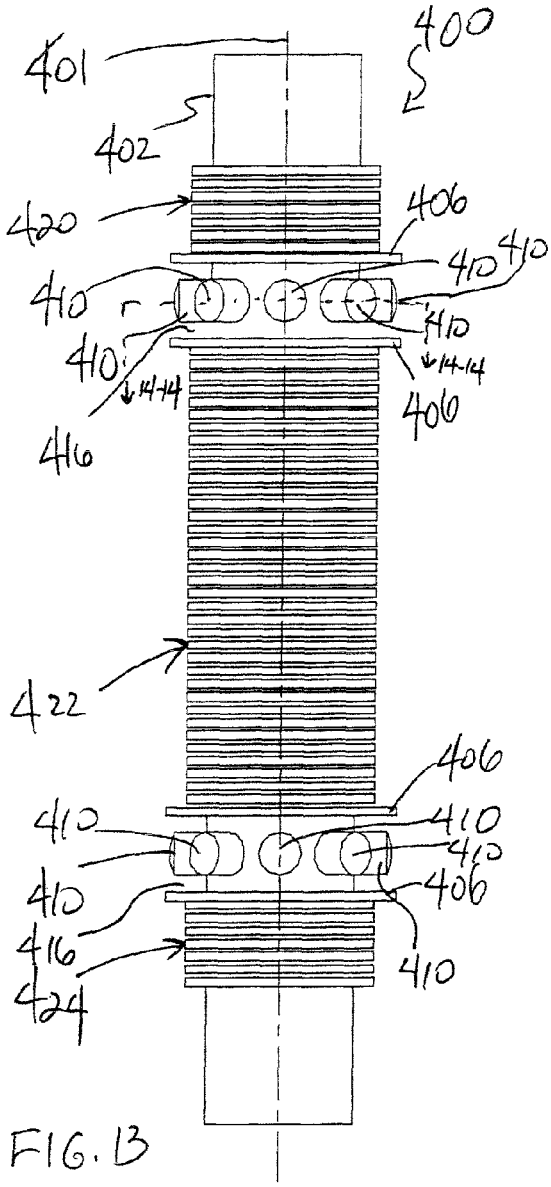
Figure 14:
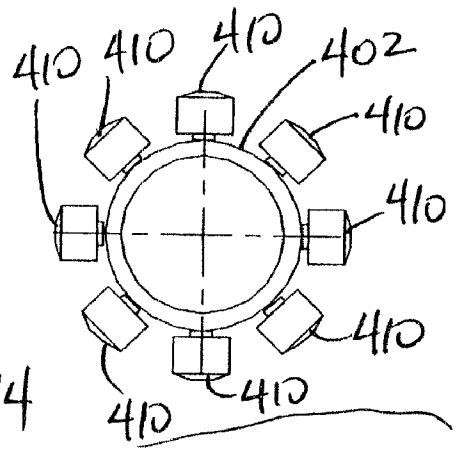
FIG. 14 is a cross-sectional view taken along line 14-14 of FIG. 13 according to an embodiment of the invention.

As an example of yet another embodiment of the invention, FIG. 13 depicts a combined perforating and sandscreen assembly 400, which may be used in place of either the assembly 300 or 34. The assembly 400 includes groups of perforating charges 410, which are aligned in the same plane. Each group of perforating charges 410 may be equally distributed around a longitudinal axis 401 of the assembly 400, as depicted in the cross-section of FIG. 14.

For this embodiment of the invention, the sandscreen is formed from multiple and separate pieces. For example, as depicted in FIG. 13, the assembly 400 includes an upper 420, middle 422 and lower 424 sandscreen sections; and collectively, the sections 420, 422 and 424 form the sandscreen for the assembly 400.

The sandscreen sections 420, 422 and 424 are spaced apart to form corresponding channels 416 that expose the perforating charges 410, which, similar to the perforating charges of the assemblies 34 and 300, are located entirely on the outside of the base pipe 402. Furthermore, radial extensions 406 may define the upper and lower boundaries of each channel 416. These radial extensions 406 may be part of the base pipe 402 or may be formed on edges of the sandscreen sections 420, 422 and 424, depending on the particular embodiment of the invention. The base pipe 402 also includes radial ports, or openings (not depicted in FIGS. 13 and 14), to receive fluid flow into the base pipe.

Although terms of direction such as "upper," "lower," etc., have been used herein for purposes of convenience, these orientations are not necessary to practice the invention. For example, in accordance with some embodiments of the invention, the BHA 30 and string 20 may be used in a lateral wellbore. Therefore, many variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An assembly usable with a well, comprising:

a base pipe comprising at least one radial port to communicate well fluid and having an outer surface;

a screen mounted to the base pipe and adapted to at least partially surround the base pipe, said at least one radial port being covered by the screen;

perforating charges mounted to the outer surface of the base pipe; and radial extensions adapted to extend radially beyond the perforating charges and screen to form a channel to receive the perforating charges and protect the screen and perforating charges;

wherein the screen comprises continuous multiple spiral windings about the base pipe, two of the windings are adjacent to each other without any other winding of the screen being disposed between said two of the windings, and the channel spirally extends between said two of the windings.

2. The assembly of claim 1, wherein the base pipe comprises ribs to establish an annular region between the outer surface and the screen.

3. The assembly of claim 1, wherein the screen comprise separate sections wrapped around the base pipe.

4. The assembly of claim 1, further comprising:

a detonating cord to extend outside of the base pipe to communicate a detonation wave to said at least one perforating charge.

5. The assembly of claim 1, wherein the base pipe, screen and said at least one perforating charge are adapted to be run as a unit into the well.

6. The assembly of claim 1, wherein the radial extensions are part of the screen.

7. The assembly of claim 1, wherein the radial extensions are separate from the screen.

8. The assembly of claim 1, wherein the radial extensions are separate from the screen.

9. A method usable with a well, comprising:

mounting a screen to a base pipe such that the screen at least partially surrounds the base pipe, the base pipe comprising at least one radial port covered by the screen;

continuously wrapping the screen in multiple windings about the base pipe, two of the windings being adjacent to each other without any other winding of the screen being disposed between said two of the windings;

mounting perforating charges to an outer surface of the base pipe;

extending radial members radially beyond the screen and perforating charges to protect the screen and perforating charges and form a channel that spirally extends between said two windings; and disposing the perforating charges in the channel.

10. The method of claim 9, wherein said at least one perforating charge is entirely located outside of the base pipe.

11. The method of claim 9, further comprising configuring the perforating charge to fire in response to at least one of the following:

an applied tubing pressure, an applied annulus pressure, a stimulus communicated via a tubing and a load signature on a string mounted to the base pipe.

12. The method of claim 9, further comprising:

configuring the tool to have a first mode in which the tool routes fluid through the base pipe and into a region surrounding the screen and a second mode in which the tool routes fluid from the region surrounding the screen into the base pipe.

13. The method of claim 9, further comprising:

running the screen, base pipe and perforating charges into the well in a single trip; and firing the perforating charges.

14. The method of claim 13, further comprising:

communicating a slurry through the assembly to perform a gravel packing operation.

15. The method of claim 13, further comprising:

downhole in the well, disconnecting a service tool to control fluid communication from the assembly and retrieving the service tool to the surface of the well.

16. The method of claim 13, further comprising:

setting a packer prior to the firing of the perforating charges.

17. The method of claim 13, wherein the running comprises stabbing an assembly containing the screen, base pipe and perforating charges into a sump packer.

18. The method of claim 13, further comprising:

changing a fluid weight in the well after the running and before the firing of the perforating charges.

19. The method of claim 9, wherein the radial members are part of the screen.

20. A system usable with a well, comprising:

a string; and a bottom hole assembly connected to the string, the bottom hole assembly comprising:

a base pipe comprising at least one opening and having an outer surface;

a screen mounted to the base pipe and adapted to at least partially surround the base pipe, said at least one opening of the base pipe being covered by the screen;

perforating charges mounted to the outer surface of the base pipe; and radial extensions adapted to extend radially beyond the perforating charges and screen to form a channel to receive the perforating charges and protect the screen and perforating charges;

wherein the screen comprises continuous multiple spiral windings about the base pipe, two of the windings are adjacent to each other without any other winding of the screen being disposed between said two of the windings, and the channel spirally extends between said two of the windings.

21. The system of claim 20, wherein at least one of said at least one perforating charge is located entirely outside of the base pipe.

* * * * *